US007842869B2

(12) United States Patent
Adams

(10) Patent No.: US 7,842,869 B2
(45) Date of Patent: Nov. 30, 2010

(54) STRING INSTRUMENT WITH IMPROVED ACOUSTIC PROPERTIES AND FIXING PLATE FOR FIXING ONE END OF THE STRINGS OF A GUITAR

(75) Inventor: Christopher Adams, Hamburg (DE)

(73) Assignee: Tectus Anstalt, Vaduz (LI)

( * ) Notice: Subject to any disclaimer, the term of this patent is extended or adjusted under 35 U.S.C. 154(b) by 237 days.

(21) Appl. No.: 11/568,541

(22) PCT Filed: Jan. 27, 2005

(86) PCT No.: PCT/EP2005/000801

§ 371 (c)(1),
(2), (4) Date: Feb. 15, 2008

(87) PCT Pub. No.: WO2005/116984

PCT Pub. Date: Dec. 8, 2005

(65) Prior Publication Data

US 2008/0271586 A1 Nov. 6, 2008

(30) Foreign Application Priority Data

May 13, 2004 (EP) ..... 04011357

(51) Int. Cl.
*G10D 3/12* (2006.01)

(52) U.S. Cl. ..... 84/297 R; 84/297 S

(58) Field of Classification Search ..... 84/297 S, 84/297 R

See application file for complete search history.

(56) References Cited

U.S. PATENT DOCUMENTS 2,573,254 A * 10/1951 Fender ..... 84/727
2,741,146 A * 4/1956 Fender ..... 84/313
3,130,626 A 4/1964 Martin
3,290,980 A * 12/1966 Fender ..... 84/307
3,313,196 A * 4/1967 Mari ..... 84/297 R
3,777,613 A * 12/1973 Chaffee et al. ..... 84/297 S
3,813,983 A 6/1974 Paul
3,896,695 A * 7/1975 Kingsbury ..... 84/307
4,018,124 A 4/1977 Rosado
4,088,052 A 5/1978 Hedrick
4,128,033 A 12/1978 Petillo (Continued)

FOREIGN PATENT DOCUMENTS

AT 006 906 U1 5/2004

(Continued)

*Primary Examiner*—Jeffrey Donels
*Assistant Examiner*—Robert W Horn
(74) *Attorney, Agent, or Firm*—Hunton & Williams LLP

(57) ABSTRACT

A string instrument with improved acoustic properties includes taut strings fixed at both ends of the instrument. An element is arranged on at least one end of at least one string, between a fixing device of a first material and the string, said element of a second material having a conductive and absorbent capacity for sound waves in the audible frequency range created by striking the strings, which is lower than the conductive or absorbent capacity of the first material in said frequency range, in such a way that the string is protected against any contact with the fixing device. The invention also relates to a fixing plate for guitars, including electronic guitars or electronic bases, having a sleeve disposed in a string hole of the fixing plate at a terminating end of a string.

14 Claims, 2 Drawing Sheets

U.S. PATENT DOCUMENTS

| | | | | | |
|---|---|---|---|---|---|
| 4,164,806 | A | * | 8/1979 | Stone et al. | 29/517 |
| 4,197,779 | A | | 4/1980 | Holman | |
| 4,202,240 | A | * | 5/1980 | Smith | 84/297 R |
| 4,318,327 | A | | 3/1982 | Toups | |
| 4,426,907 | A | | 1/1984 | Scholz | |
| 4,453,443 | A | * | 6/1984 | Smith | 84/298 |
| 4,572,049 | A | * | 2/1986 | Tanaka et al. | 84/313 |
| 4,681,010 | A | | 7/1987 | Wilkinson | |
| 4,791,849 | A | | 12/1988 | Kelley | |
| 4,803,908 | A | | 2/1989 | Skinn et al. | |
| 4,840,103 | A | * | 6/1989 | Mayer | 84/297 R |
| 4,860,628 | A | * | 8/1989 | Storey | 84/313 |
| 4,903,568 | A | * | 2/1990 | Itoh | 84/313 |
| 4,909,126 | A | | 3/1990 | Skinn et al. | |
| 4,939,971 | A | * | 7/1990 | Satoh | 84/313 |
| 5,065,660 | A | | 11/1991 | de Buda | |
| 5,088,374 | A | * | 2/1992 | Saijo | 84/313 |
| 5,140,884 | A | * | 8/1992 | Bowden | 84/312 R |
| 5,265,513 | A | | 11/1993 | Smith | |
| 5,337,664 | A | | 8/1994 | Hannon | |
| 5,343,793 | A | | 9/1994 | Pattie | |
| 5,390,579 | A | | 2/1995 | Burgon | |
| 5,477,764 | A | * | 12/1995 | Carrico | 84/297 R |
| 5,767,429 | A | | 6/1998 | Milano et al. | |
| 5,945,615 | A | * | 8/1999 | Rose | 84/297 S |
| 5,986,190 | A | * | 11/1999 | Wolff et al. | 84/297 R |
| 6,111,176 | A | * | 8/2000 | Rose | 84/297 S |
| 6,184,450 | B1 | | 2/2001 | LeBlanc | |
| 6,184,452 | B1 | | 2/2001 | Long et al. | |
| 6,271,456 | B1 | | 8/2001 | Nelson | |
| 6,278,047 | B1 | | 8/2001 | Cumberland | |
| 6,348,646 | B1 | * | 2/2002 | Parker et al. | 84/297 R |
| 6,369,306 | B2 | * | 4/2002 | Chapman | 84/314 R |
| 6,613,969 | B1 | * | 9/2003 | Petillo et al. | 84/314 R |
| 6,891,094 | B2 | * | 5/2005 | McCabe | 84/312 R |
| 7,098,391 | B2 | * | 8/2006 | Wilson | 84/453 |
| 7,351,894 | B2 | * | 4/2008 | Butler et al. | 84/267 |
| 7,365,255 | B1 | * | 4/2008 | Piskulic et al. | 84/298 |
| 7,482,518 | B1 | * | 1/2009 | DiSanto | 84/291 |
| 2002/0002893 | A1 | * | 1/2002 | Genssler | 84/297 S |
| 2002/0104428 | A1 | * | 8/2002 | Wilson | 84/453 |
| 2003/0140765 | A1 | * | 7/2003 | Herman | 84/314 R |
| 2004/0040432 | A1 | * | 3/2004 | Erickson et al. | 84/306 |
| 2004/0129129 | A1 | * | 7/2004 | Wilson | 84/453 |
| 2005/0072289 | A1 | * | 4/2005 | Butler | 84/312 R |
| 2008/0190273 | A1 | * | 8/2008 | Adams | 84/731 |
| 2008/0202311 | A1 | * | 8/2008 | Holdway | 84/294 |
| 2008/0271586 | A1 | * | 11/2008 | Adams | 84/313 |
| 2008/0282869 | A1 | * | 11/2008 | Adams | 84/455 |

FOREIGN PATENT DOCUMENTS

| | | | |
|---|---|---|---|
| DE | 35 09 662 | A1 | 10/1986 |
| FR | 2 365 850 | | 4/1978 |
| GB | 2 226 910 | A | 7/1990 |
| WO | WO 97/04442 | | 2/1997 |
| WO | WO 01/67431 | A1 | 9/2001 |
| WO | WO 03/012774 | A1 | 2/2003 |
| WO | WO 2005/114647 | A1 | 12/2005 |
| WO | WO 2005/116984 | A1 | 12/2005 |
| WO | WO 2005/116985 | A1 | 12/2005 |
| WO | WO 2005/116986 | A1 | 12/2005 |
| WO | WO 2006/076928 | A2 | 7/2006 |

* cited by examiner

STRING INSTRUMENT WITH IMPROVED ACOUSTIC PROPERTIES AND FIXING PLATE FOR FIXING ONE END OF THE STRINGS OF A GUITAR

BACKGROUND OF THE INVENTION

The present invention relates to a method for improving the sound properties, in particular the sustain, of a string instrument. The invention also relates to an improved fixing plate for affixing each end of the strings of an a guitar, in particular an electric guitar or an electric bass guitar, with which fixing plate yields an improvement of the sound properties, in particular the sustain, of a guitar or an electric bass guitar.

On string instruments, the strings are tensioned so that, after having been struck, they vibrate at a specific frequency and generate a corresponding note. The tensioned strings are fastened on both ends, with one end of the strings generally being fastened so as to not be adjustable or only slightly adjustable and with the other end of the strings, for example, being wound on a wedge or another device for adjusting the length and tension of the strings.

Thus, guitars, in particular electric guitars and electric bass guitars, can be roughly divided into a body, a neck and a head. The strings of the instruments which generate the sound are tensioned at the head via the neck* up to the body. The strings with a first end are affixed to a fixing plate, on electric guitars frequently in the form of a so-called tremolo system block, that is attached to the body of the instrument. From there, the strings extend along the body via the neck to the head where they are wound on tuning pegs. By turning the tuning pegs, the strings are tightened or loosened and thereby tuned.

*[Translator's note: In the source text, the term "Steg" (bridge) is mistakenly used to describe the neck of the guitar.]

In the fixing plate, the strings, with a thickening, a so-called ball end, that is attached at this end, are normally held in place on a contact rim of a hole that is located in the fixing plate. The strings subsequently extend through the hole and are diverted on the fixing plate via a diverting element and guided via the body and the neck to the head.

The known guitars and electric bass guitars generally have a fixing plate that is made of a metal, which fixing plate has a number of holes that are spaced at regular intervals, said number of holes corresponding to the number of strings, which holes serve to affix the ends of the strings of the instrument.

Musicians using this type of instrument often wish that their instrument had a long sustain. This means that after plucking the string, the sound generated does not immediately stop, but that instead the string continues to vibrate even after it has been released. "Normal" guitars, in particular electric guitars and electric bass guitars, in the medium and low price range do not have this sound property to the extent desired. Frequently, particularly hobby musicians, must therefore make do without this property since they are either unable to afford or are unwilling to purchase especially expensive and high-quality instruments that have design characteristics for achieving an improved sustain.

Similarly, a sustain is frequently desired in other string instruments, e.g., harp, piano, bowed instruments, etc., as well, except that it cannot be achieved to the extent desired because of the dampening of the vibrating string.

SUMMARY OF THE INVENTION

It is therefore the objective of the present invention to make available a simple means for improving the sound properties, in particular the sustain, of a string instrument, in particular a guitar, preferably an electric guitar or an electric bass guitar. This means should be simple and inexpensive and, in particular, should also be suitable for retrofitting existing string instruments.

To solve this problem, a method for improving the sound properties, in particular the sustain, of a string instrument which has tensioned strings that are affixed on both ends, wherein, between a fixing device made of a first material and the string, an element made of a second material having conductive and absorbent properties for sound waves in the range of the audible frequency range that is generated by striking the strings lower than the conductive and absorbent properties of the first material in this frequency range is disposed at least on one end of at least one string so that the string is shielded by said element from contact with the fixing device is disclosed. In addition, an improved fixing plate for a guitar, in particular an electric guitar and an electric bass guitar, with holes for holding in place one end each of strings strung onto the guitar or the electric bass guitar, with each end of said strings having a thickening (ball end), said holes passing through the fixing plate that is made of a first material, characterized in that in at least one hole, a sleeve is disposed in such a way that at least the thickening on the end of the string rests against the sleeve and is separated from the first material of the fixing plate by the sleeve, said sleeve being made of a second material having a conductive and absorbent capacity for sound waves in the range of the audible frequency range generated when the strings are struck lower than the conductive and absorbent capacity of the first material in this frequency range is proposed.

The core of the invention is to be seen in the surprising discovery that by incorporating, between the string and the fixing device, an element made of a material which—compared to the material of a fixing device, with which fixing device one of the ends of at least one string of a string instrument is affixed—has lower conductive and absorbent properties for sound waves in the range of the audible frequency range that is generated by striking the strings, it is possible to achieve a markedly longer continued vibration of the string and thus a longer sustain of the string. The inventor made this discovery in the course of development activities for improving another aspect of electric guitars, which means that he surprisingly acquired the knowledge that underlies the present invention. As the inventor discovered, the scope and application possibility of the invention is not limited specifically to electric guitars or similar string instruments but to any string instruments in general.

Based on the present understanding of the invention, the incorporation of the element according to the present invention leads to an improvement of the sustain of the string instrument in that especially the string that normally rests directly against the material of the fixation device transfers the vibrations directly to the material of the fixing device where said vibrations are then dampened. The intermediate location of the element according to the present invention decreases the ability of the material to absorb and dampen the vibrations of the string, thus allowing the string to vibrate for a longer time. To this end, it is essential that the element be located at least within that region of the fixing device in which the string normally would rest against the material of the fixing device but now rests against the element as such.

Another effect resulting from the use of the element according to the present invention is that the upper partials as well can be heard more clearly or that such upper partials which normally are immediately lost because of the dampening continue to co-vibrate in the sound of the string instrument. This makes the sound of the string instrument fuller overall and thus contributes further to the improvement of the sound properties of the string instrument.

It has been found that elements made of a ceramic, synthetic and/or glass material that are disposed between the fixing unit and the string are suitable for use with a metal fixing device (for example, a fixing plate, in particular one in the form of a tremolo system block) in embodiments of the invention.

One embodiment of the invention discloses a solution of the problem posed by the invention that is specifically implemented for use of the invention for guitars, in particular electric guitars and electric bass guitars. The fixing plate may, in particular, also be a tremolo system block which is frequently encountered on an electric guitar.

If the sleeves that are inserted into the holes in the fixing plate extend along the entire length of the holes, the absorbent properties of the material of the fixing plate are also suppressed in the region in which the string, although it does not rest directly against said fixing plate, still transmits sound waves into the direction of said fixing plate, which achieves an even better sustain and an even better co-vibration of the upper partials in embodiments of the invention.

To improve the sound properties of all notes that can be played with the guitar and the electric bass guitar, it is preferable for a sleeve according to the present invention to be disposed in each of the holes in the fixing plate in one embodiment of the invention.

Lastly, a guitar, in particular an electric guitar and an electric bass guitar, is disclosed and claimed, which guitar or bass guitar comprises a fixing plate that is improved in embodiments of the invention.

The method described is especially suitable in that it allows the retrofitting of already existing string instruments, for example, guitars or electric bass guitars, by adding elements made of a material according to the present invention to the already existing fixing devices or, if this is not possible, by replacing the fixing device as such. Both measures entail relatively low costs which are at any rate considerably lower than the cost of purchasing a high-quality string instrument that achieves comparable sound properties because of its special design features.

The invention will be explained in greater detail below based on a practical example shown in the figures to which reference is made.

As can be seen:

DETAILED DESCRIPTION OF THE INVENTION

In the figures, identical or identically functioning components have the same reference numbers.

In the practical example, the invention is explained based on a practical example [sic] of an electric guitar in which the fixing plate is a tremolo system block. This practical example serves to explain the invention, without however limiting the invention to this specific application. Instead, the invention comprises the entire spectrum as specified in the claims.

Figure 1:
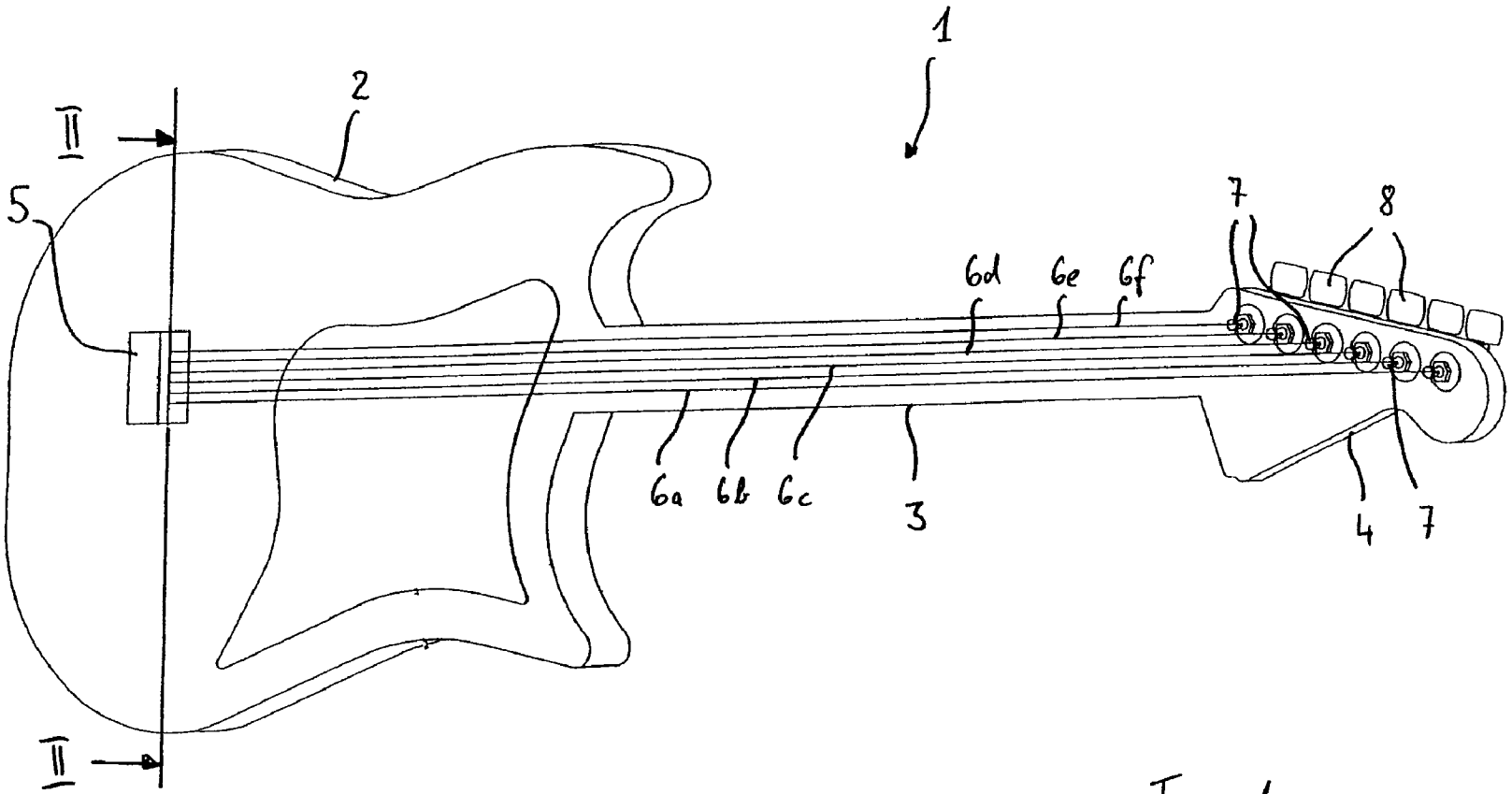
FIG. 1 shows a diagrammatic representation of an electric guitar.

FIG. 1 is a diagrammatic representation of an electric guitar 1 in a three-dimensional view. The electric guitar 1 comprises a body 2, a neck 3 and a head 4. The so-called tremolo system block is disposed on the body 2. A first end of strings 6*a* to 6*f* of the electric guitar 1 is affixed on said tremolo system block in a manner that will be described in detail based on FIGS. 2 and 3. The other end of strings 6*a* to 6*f* is wound around tuning pegs 7 that are disposed on head 4 of the electric guitar 1, and said tuning pegs 7 can be turned by turning the peg winders 8 so that strings 6*a* to 6*f* can be tensioned or loosened to tune the electric guitar 1.

The present invention relates to a tremolo system block 5 that is modified when compared to a prior-art tremolo system block of a conventional electric guitar. The modification can be especially clearly seen in FIGS. 2 and 3.

The tremolo system block 6 comprises holes 9, one hole 9 for each of strings 6*a* to 6*f*. As viewed in FIG. 1, these holes extend perpendicular to the drawing plane of said figure, i.e., the ends of strings 6*a* to 6*f* that are located on the tremolo system block 5 are deflected at an angle of approximately 90°. This end of strings 6*a* to 6*f* has a thickening 10 (also called the ball end). On a conventional electric guitar, this thickening locks the end of each of strings 6*a* to 6*f* into position on the tremolo system block 5, which usually is made of metal, or more precisely on a rim of hole 9.

This is where the invention comes into play in that it provides that between the material of the tremolo system block 5 (in this practical example made of steel) and the thickening 10 on the end of each string 6*a* to 6*f*, a sleeve 11 be inserted into hole 9. In this practical example, sleeve 11 is made of a ceramic material. As a result, the thickening 10 on the end of string 6*a* to 6*f* no longer rests directly against the metal of the tremolo system block but against the ceramic material of sleeve 11. Compared to the metal of the tremolo system block 5, the ceramic material of sleeve 11 has a considerably inferior absorbent and conductive property for the sound or the sound waves generated by strings 6*a* to 6*f*. As a result, after the string is struck, the vibration of strings 6*a* to 6*f* is not dampened as rapidly, the string continues to vibrate longer and leads to a considerably improved sustain when compared to an otherwise identically constructed electric guitar with a unchanged tremolo system block.

Figure 2:
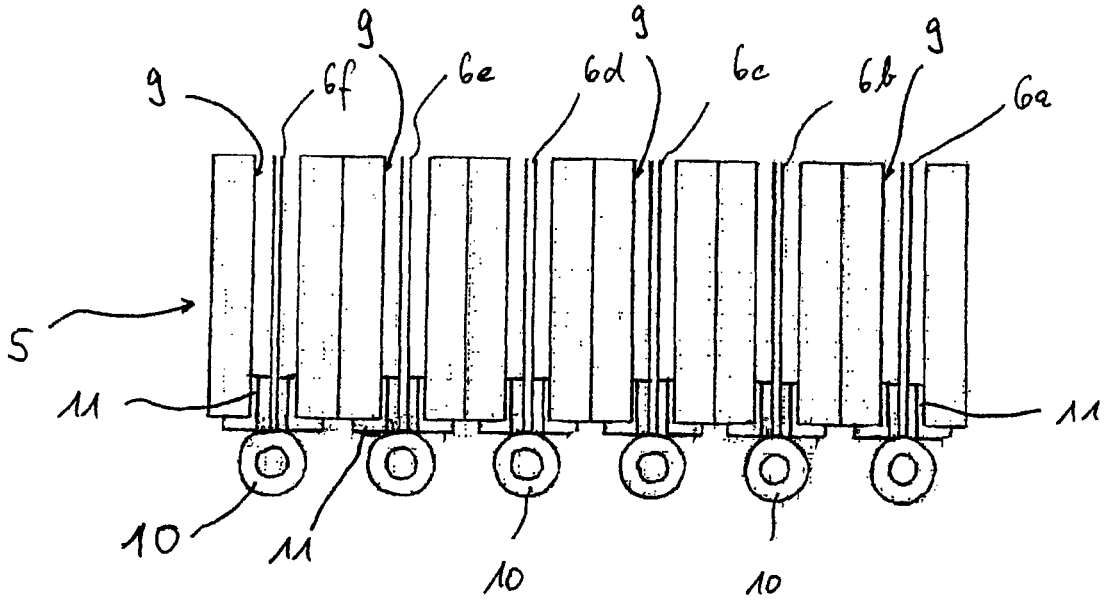
FIG. 2 shows a diagrammatic representation of a cross section through the tremolo system block along line II-II seen in FIG. 1.

In FIG. 2, sleeves 11 are designed in the form of short sleeves which occupy substantially only the region in which the thickening 10 on the end of strings 6*a* to 6*f* would normally rest against the material of the tremolo system block but now rests against the material of sleeve 11.

Figure 3:
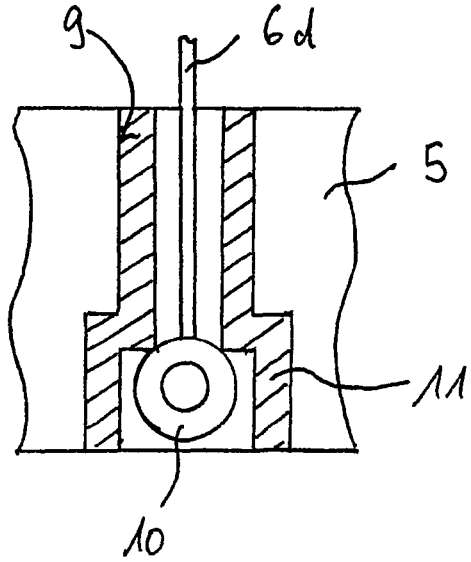
FIG. 3 shows a segment of the tremolo system block in a cross-sectional diagram similar to the one shown in FIG. 2, except that the design differs slightly from the practical example of FIG. 2.

FIG. 3 illustrates a variation of hole 9 and sleeve 11. In this figure, hole 9 is a hole that is expanded in what in the figure is shown to be the bottom end of the tremolo system block 5. In this manner, a recess is created, which houses the entire thickening 10, thus ensuring that said thickening does not project out of what in the figure is shown to be the bottom end of the tremolo system block 5. In addition, the entire length of sleeve 11 is designed so as to extend along the entire length of the hole 9. This contributes to a further reduction of the absorption of the sound waves that are generated as the string (6*a*-6*f*) is struck and thus to an improved sustain and an improved sound of the guitar with respect to the audible upper partials.

The embodiments of the tremolo system block 5 modified according to the present invention and shown especially in FIGS. 2 and 3 are not intended to limit the invention; instead, many variations and mixed forms of embodiments are possible. It is only important that a sleeve 11 formed into the material be inserted between the material of the tremolo system block 5 and at least the thickening 10 on the end of strings 6*a* to 6*f*.

The scope of the invention is in no way intended to be limited to the practical example; instead, the invention and its scope are solely identified and disclosed by the following claims.

LIST OF REFERENCE NUMERALS

1 Electric guitar
2 Body
3 Neck
4 Head
5 Tremolo system block
6*a-f* String
7 Tuning peg
8 Peg winder
9 Hole
10 Thickening
11 Sleeve

The invention claimed is:

1. A string instrument comprising:

a tensioned string that is affixed on both ends, wherein a string passes through a hole in a fixing device made of a first material; and a shield element shielding at least a portion of the hole and holding a terminating end of the string in place without contact of said terminating end to the first material of the fixing device, wherein the shield element is made of a second material having conductive and absorbent capacity for sound waves in the range of the audible frequency range that is generated by striking the string lower than the conductive and absorbent capacity of the first material;

wherein the shield element extends along the entire length of the hole; and wherein the terminating end of the string is held in place by a thickening of said string end that abuts the shield element.

2. The string instrument as in claim 1, wherein the first material of the fixing device is a metal and the second material of the shield element includes at least one material selected from the group consisting of a ceramic and glass material.

3. The string instrument of claim 1, wherein the fixing device is a fixing plate of a guitar disposed on the body of the guitar.

4. The string instrument as in claim 1, wherein the string and fixing device are disposed in a guitar.

5. The string instrument as in claim 1, wherein the thickening is a ball end.

6. The string instrument as in claim 1, wherein the hole includes a top aperture and a recessed portion at a bottom aperture wider than the top aperture.

7. The string instrument as in claim 1, wherein the first material of the fixing device is a metal and the second material of the shield element includes at least one synthetic material.

8. A fixing plate for a guitar comprising:

one or more string holes passing through the fixing plate that is made of a first material; and at least one sleeve disposed in a hole of said one or more string holes and abutting a terminating end of a guitar string to shield contact with the first material, wherein the at least one sleeve is made of a second material having a conductive and absorbent capacity for sound waves in the range of the audible frequency range generated when the strings are struck lower than the conductive and absorbent capacity of the first material in this frequency range;

wherein the at least one sleeve in its longitudinal extension extends along the entire length of a hole.

9. The fixing plate as in claim 8, wherein the first material of the fixing plate is a metal and the at least one sleeve has a second material including at least one material selected from the group consisting of a ceramic and glass material.

10. The fixing plate as in claim 8, wherein a sleeve is disposed in each of the one or more holes.

11. The fixing plate as in claim 8, further comprising at least one string under tension passing through the at least one sleeve in at least one string hole, wherein an end of said at least one string includes a thickening abutting the sleeve to secure said at least one string in the fixing plate without contacting the first material of the fixing plate.

12. The fixing plate as in claim 11, wherein the thickening is a ball end.

13. The string instrument as in claim 6, wherein the terminating end of the string includes a ball end.

14. The fixing plate as in claim 8, wherein the first material of the fixing plate is a metal and the at least one sleeve has a second material including at least one synthetic material.

* * * * *